United States Patent [19]

Gadde

[11] Patent Number: 4,688,024

[45] Date of Patent: Aug. 18, 1987

[54] BARRIER ARRANGEMENT AND A METHOD FOR PRODUCING THE SAME

[75] Inventor: Villy Gadde, Västervik, Sweden

[73] Assignee: Safe Bridge AB, Vastervik, Sweden

[21] Appl. No.: 940,813

[22] PCT Filed: Apr. 23, 1986

[86] PCT No.: PCT/SE86/00188

§ 371 Date: Nov. 19, 1986

§ 102(e) Date: Nov. 19, 1986

[87] PCT Pub. No.: WO86/06465

PCT Pub. Date: Nov. 6, 1986

[30] Foreign Application Priority Data

Apr. 24, 1985 [SE] Sweden ..... 8501996

[51] Int. Cl.[4] ..... G08B 13/00

[52] U.S. Cl. ..... 340/550; 256/1; 256/23; 405/52; 405/63; 405/303

[58] Field of Search ..... 405/15–17, 405/30–35, 21–25, 52, 60, 63, 64; 256/23, 1; 340/550

[56] References Cited

U.S. PATENT DOCUMENTS

| | | | |
|---|---|---|---|
| 2,391,059 | 12/1945 | MacFarren | 405/52 X |
| 3,456,265 | 7/1969 | Carnahan | 405/67 X |
| 3,691,773 | 9/1972 | Ruhlman | 405/70 |
| 3,984,987 | 10/1976 | Light | 405/63 |
| 4,097,025 | 6/1978 | Dettmann et al. | 256/1 |
| 4,201,495 | 5/1980 | Preus | 405/63 |
| 4,252,461 | 2/1981 | Colamussi et al. | 405/64 X |
| 4,293,778 | 10/1981 | Williams | 340/550 X |
| 4,399,430 | 8/1983 | Kitchen | 340/550 |
| 4,450,434 | 5/1984 | Nielsen et al. | 340/550 X |

FOREIGN PATENT DOCUMENTS

| | | | |
|---|---|---|---|
| 275238 | 6/1914 | Fed. Rep. of Germany | 340/550 |
| 2552133 | 3/1985 | France | 405/63 |
| 548446 | 9/1956 | Italy | 256/23 |

*Primary Examiner*—Dennis L. Taylor
*Attorney, Agent, or Firm*—Sughrue, Mion, Zinn, Macpeak and Seas

[57] ABSTRACT

A barrier arrangement for blocking a water passage or channel against the admission of a foreign or unfamiliar object, such as underwater vessels, frogmen and the like. The arrangement comprises a net (1) of considerable tensile strength intended to be stretched across the water passage. The bottom edge of the net (1) is anchored to the sea-bed and the net can be activated from a passive state, in which it may lie on the sea-bed, to an active barrier state. To this end, the upper edge of the net (1) is connected to an inflatable and deflatable lifting hose (3) which when evacuated is essentially flat and which when inflated is able to lift the upper edge of the net towards the surface of the water, so as to stretch the net between the sea-bed and the surface of the water. The invention also relates to a barrier net and to an anchoring means for use with the arrangement.

6 Claims, 5 Drawing Figures

BARRIER ARRANGEMENT AND A METHOD FOR PRODUCING THE SAME

The present invention relates to a barrier arrangement for blocking a water passage or channel against the admission of unfamiliar or foreign objects, such as underwater vessels, frogmen and the like. The barrier net has considerable tensile strength and is intended to be stretched across the water passage or channel to be guarded, and the net is comprised of lines which incorporate electrical conductors insulated from the surroundings and intended to carry a close ciruit current. The invention also relates to a method for use when producing the aforesaid arrangement.

Several instances are to be found where it is desirable to prevent the admission of foreign or unfamiliar objects to a particular passage of water. In the case of national defence such prevention may concern the entry of underwater vessels, frogmen and the like to restricted areas. Corresponding precautions will sometimes also apply in the case of civil activities. One problem prevailing with barriers of this nature is that they cannot be left permanently erected, since normally the channel of water concerned must be open to working traffic and to pleasure traffic. It must be possible, however, to erect or position such barriers quickly when the need arises. This problem is solved with an arrangement according to the above in which the bottom edge of the net is anchored to the sea-bed and the net arranged to be activated from a passive state, in which the net may rest against the sea-bed, to an active barrier state. To this end the upper edge of the net is connected to an inflatable and deflatable lifting hose which when evacuated is essentially flat and which when inflated is able to lift the upper edge of the net towards the surface of the water, so as to stretch the net between the sea-bed and said surface.

Another problem is that the net used in the arrangement must be capable of absorbing and withstanding extremely large tensile forces, for example in order to prevent submarines from penetrating the net. In order to meet this requirement the net must comprise, inter alia, ropes or lines of such thickness that it will be impossible to knot the net in a conventional manner. Consequently, the ropes are connected together at their points of intersection with the aid of elements moulded from a thermoplastic material.

In barrier arrangements of the aforesaid kind it is essential that the net, which is normally not guarded or monitored, cannot be detached from its attachment points unnoticed.

This problem is solved in accordance with the invention by braiding the upper and lower edges of the net together with anchoring bodies located on the sea bottom and with the aforesaid lifting hose, respectively, with the aid of lines which incorporate electrical conductors which are insulated against contact with the surroundings and through which a close circuit current is intended to pass; and in that the aforesaid conductors are connected to an alarm device, to which the conductors incorporated in the ropes or lines from which the net is comprised are also connected; and in that the alarm unit is arranged to be activated in the event of an earth fault or a short circuit in any of the connected conductors.

The bottom edge of the net is preferably anchored to an elongated anchoring body which conforms accurately to the profile of the sea-bed.

In accordance with one embodiment, the side edges of the net are slideably connected to vertical posts or uprights.

The net is preferably comprised of sections braided together by means of a line which incorporates a signal conductor connected to the alarm device.

A barrier arrangement thus constructed can be placed conveniently across all water passages or channels where it is desired to block the passage or channel under certain circumstances, since when in its passive. state the net will not impede the passage of normal sea traffic and can be brought to its active barrier state within the space of one or two minutes. Means may be provided which enable the barrier to be brought to its active state by remote control, for example via the telephone. The alarm signal produced by the alarm device may also be passed on via the telephone network.

In order to prevent frogmen and the like passing under the net, it is necessary for the bottom of the net to lie extremely close to the sea-bed and to follow the profile thereof.

This is achieved with the aid of a method according to the invention intended for use when providing a barrier arrangement according to the aforegoing. Accordingly, in order to provide a net-anchoring body which conforms accurately to the profile of the sea-bed a flexible hose is placed on the sea-bed and subsequently filled with liquid concrete, which is permitted to harden in the hose so as to form an elongated anchoring body which conforms well to the profile of the sea-bed, whereafter the net is anchored to the anchoring body at given locations therealong.

These anchoring locations are preferably provided by inserting attachment means through the hose wall and into the concrete contained therein, prior to the concrete hardening.

This method of anchoring the net ensures that the bottom of the net conforms to and is held close against the sea-bed, thus making it impossible for objects to pass beneath the net and also making it difficult to move the net. The anchoring body can be readily provided, by simply filling a hose placed on the sea-bed with liquid concrete from one end of the hose. The net attachment means can then be driven through the hose wall and into the still liquid concrete, by a frogman or diver etc. This eliminates the need of providing complicated moulds on the sea-bed and subsequently casting anchorage sites therein. The invention will now be described in more detail with reference to the accompanying drawings.

Figure 5:
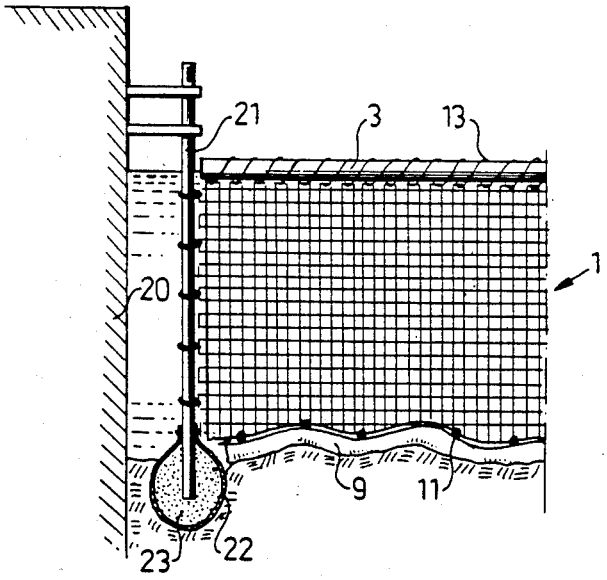

FIG. 5 illustrates means for securing one side of the net. The barrier arrangement illustrated in FIG. 1 includes a signal net 1 which is anchored along its bottom edge to an elongated anchoring body 2 provided on the sea-bed. The top edge of the net 1 is attached to an inflatable and deflatable lifting hose 3 which is inflated with pressurized air and which when inflated holds the net vertically stretched between the sea-bed and the surface of the water.

In order to bar the advance of underwater vessels in the illustrated context, the net must be capable of withstanding extremely high tensile forces. Consequently, the lines or ropes 4 of the net are, to this end, provided with a core comprising double signal conductors 5 which are insulated from one another and mutually enclosed in a watertight sheath 6, said core being covered with polyester/silk 7. It can be mentioned by way of example that a line of this construction having a diameter of 13.5 mm can withstand a tensile load of 2100 kilopound.

One problem with a line 4 of this nature, however, is that it cannot be knotted in the manner required in conventional net manufacturing processes. This problem is solved in accordance with the present invention by connecting respective vertically and horizontally extending lines 4 at their mutual points of intersection in an inseparable fashion with the aid of plastic elements which are moulded directly over the said points of intersection. The plastics material may be polyurethane. Polyurethane provides good ashesion against the polyester rope or line and is highly wear resistant. The polyurethane element cannot be sawn away or removed in any other way from its associated intersection point on the net without damaging the lines. It will be understood, however, that other materials suitable for this purpose may be used.

The signal conductors 5 incorporated in the lines or ropes are connected to a signal emitter which permits a low close circuit current to pass through the conductors and which gives-off an alarm signal upon the occurrence of an earth fault or a break in the circuit. Such signal emitting devices can be constructed in various ways obvious to those skilled in the electronic field, and consequently the signal emitting device forms no part of the present invention and will not be described in detail here.

In order to prevent totally the passage of objects under the net 1, it must be anchored to the sea-bed at short distances along the bottom of the net, in a manner which ensures that the bottom of the net closely follows the profile of the sea-bed. This is achieved in accordance with the invention with the aid of an elongated anchoring body which is manufactured by first placing a flexible hose 9 on the sea-bed; filling the hose from one end thereof with liquid concrete 10; and allowing the concrete to harden within the hose so as to form an elongated anchoring body which conforms to the profile of the sea-bed. Prior to the concrete hardening in the hose, anchoring means 11 are pressed through the hose wall and into the concrete 10 located in the hose 9. This can be readily carried out by a frogman.

Extremely long anchoring bodies which conform to all irregularities in the sea-bed can be constructed in the aforedescribed manner in the absence of conventional formwork, which is difficult to provide on the sea-bed. Such anchoring bodies can be placed in reserve at relatively low cost at sites where it may be found necessary at a later date to erect a barrier net. The alternative of manufacturing ready-to-use moulds and lowering the moulds onto the sea-bed is much more expensive and does not provide a facility by means of which the bottom of the net can be made to follow the contours of the seabed. When desired, or when found necessary, the hose can be filled with concrete from a number of filling locations distributed therealong, either simultaneously, or in accordance with a given sequence. The hose 9 may have any desired diameter, suitably within the range of 20–50 cm, depending upon the application in question.

As will be understood, the aforedescribed anchoring body constructed in accordance with the invention for anchoring a barrier net to the sea-bed may be used equally as beneficially to anchor other objects, such as floating landing stages for example. The technique can also be applied on land, in order to provide a close fitting between a net or fence and the ground upon which it is erected. In this case, hoses having lengths equalling many tens of meters can be filled, for example, with concrete from one and the same inlet.

Figure 1:
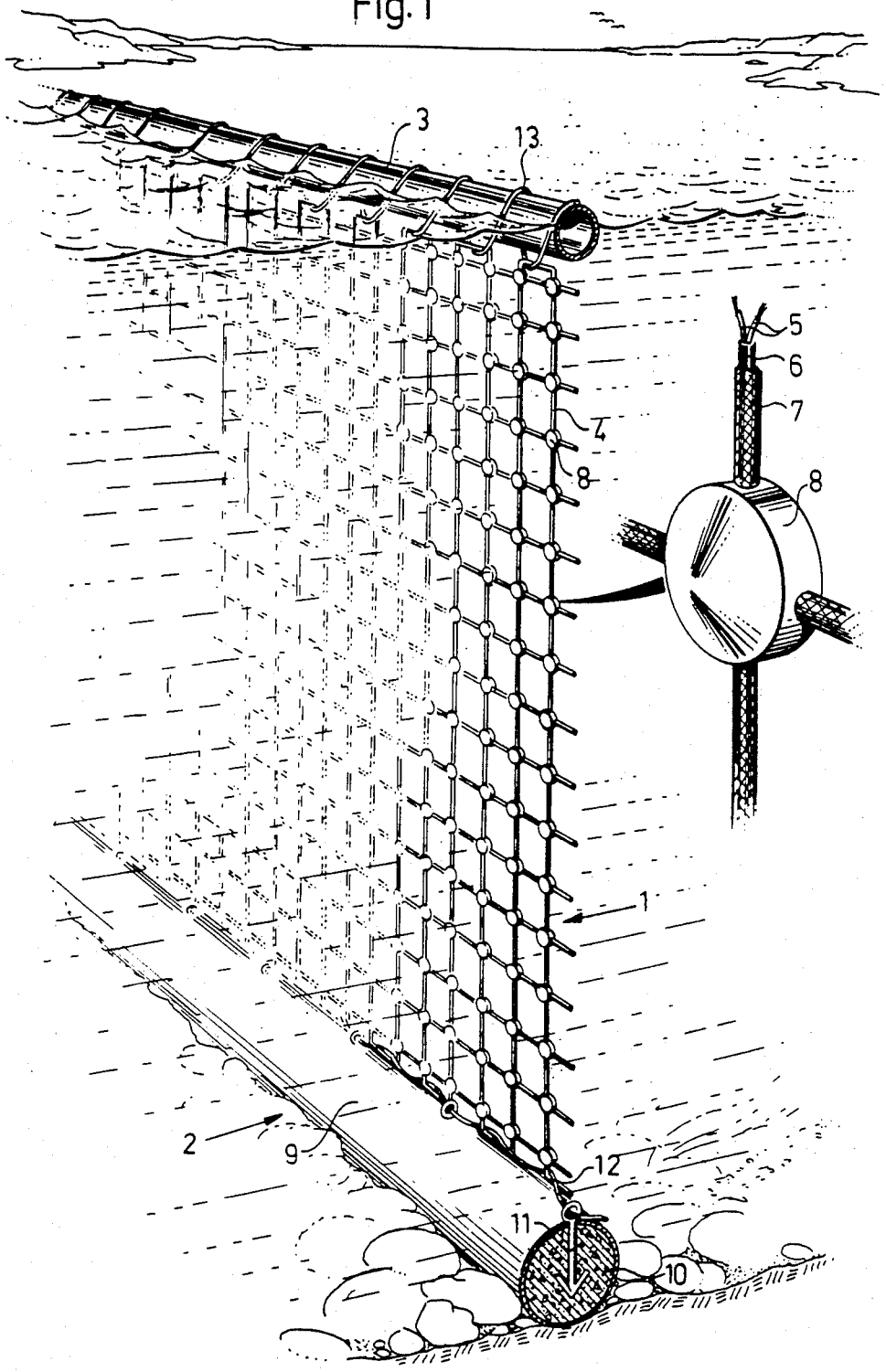
FIG. 1 is a perspektive, sectional view of a barrier arrangement, according to the invention.

In the case of the embodiment illustrated in FIG. 1 the net 1 is firmly braided to eye-pieces provided on the attachment means 11 pressed into the anchoring body 9, with the aid of a line 12 which is connected to a signal emitting device and acts as a signal conductor in a manner to cause an alarm to be given in the event of an earth fault or a break in the circuit. Similarly, the upper edge of the net is firmly braided to the lifting hose 3 with the aid of a line 13, which also functions as a signal conductor.

Figure 2:
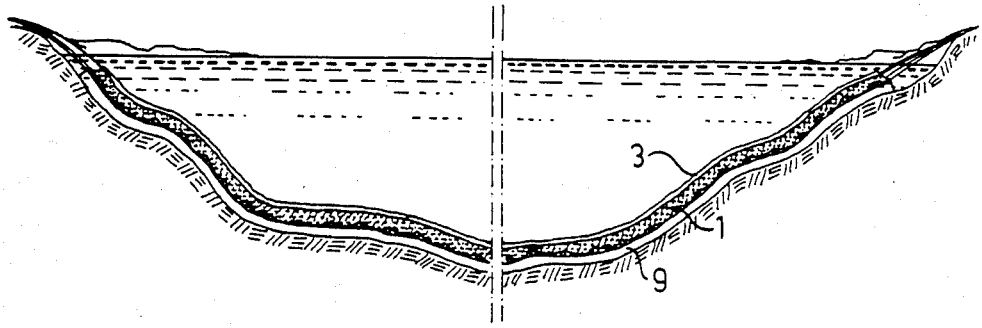
FIG. 2 illustrates schematically the barrier arrangement in its passive state.

In order to enable the barrier to be removed, so that normal sea traffic can enter the guarded water passage or channel at times when the barrier is not needed, the lifting hose 3 is provided with means which enable the hose to be evacuated and collapsed. When the hose 3 is collapsed, the net will drop onto the sea-bed and there lie in a prepared state, of FIG. 2, for subsequent activation to its active barrier position, this activation of the net being effected by connecting a compressor to the hose 3. The compressor may also be utilized to effect subsequent evacuation of the hose through the agency of an ejector, by means of a suitable compressor coupling. Alternatively, the hose can be evacuated with the aid of a vacuum tank. In order to withstand the high pressures likely to be required in this respect, the lifting hose is suitably constructed in the manner of a conventional fire hose having a diameter corresponding to the requisite lifting forces.

Figure 3:
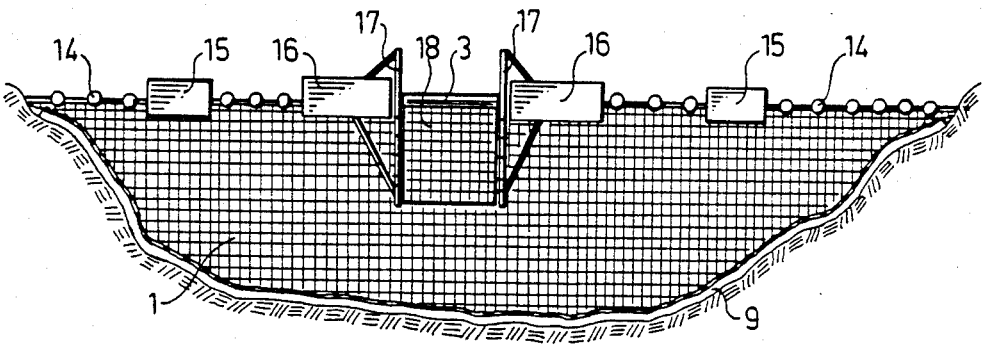
FIG. 3 illustrates a particular embodiment of a barrier arrangement according to the invention.

FIG. 3 illustrates a special arrangement which can be used when normally holding a water passage or channel blocked and which will nevertheless permit working vessels to pass through when required. In this case, the water passage is held blocked with the aid of a net 1 which is anchored to a sea-bed anchorage according to FIG. 1 and which is held vertically stretched with the aid of floating buoys 14 and floating pontoons 15. The reference 16 identifies two pontoons each of which carries a respective vertical pipe 17, these pipes functioning as guides for a raisable and lowerable section 18 of a net constructed in accordance with FIG. 1. The top edge of the net section 18 is attached to a lifting hose 3, and can be raised and lowered by inflating and deflating said hose.

Figure 4:
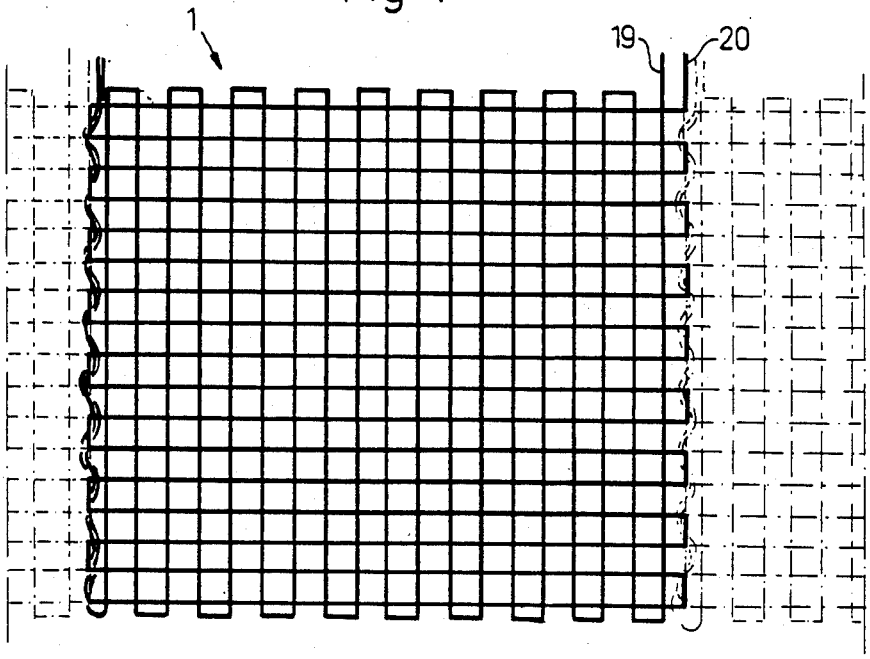
FIG. 4 illustrates the construction of the net in sections.

As illustrated in FIG. 4, the net 1 illustrated in FIG. 1 is built-up of sections, each of which comprises two continuous lines, i.e. one line 19 which forms the vertical strands of the net and one line 20 which forms the horizontal net strands. These lines are also used to braid the net sections together along the full height of the net, as illustrated in FIG. 4. If desired, the signal conductors incorporated in respective net sections may be connected-up so that if the net is attacked the signal emitting device will indicate the net section against which the attack is directed.

FIG. 5 illustrates a method of attaching a net 1 according to FIG. 1 to a bridge foundation 20. In this embodiment, the net is connected to a tubular post 21 attached to the bridge foundation 20 and also anchored to the sea-bed, the net being raisable and lowerable along said post. The sea-bed anchorage can be achieved by encasing the lower end of the post 21 in a plastic bag 22 and by filling the bag with liquid concrete 23 introduced through the tubular post 21. This enables the post to be reliably anchored onto the sea-bed, particularly if the lower end of the post lies in a cavity or hollow in the sea-bed.

Although the arrangement according to the invention has been described essentially with regard to blocking water passages or channels, a similar technique can also be used on dry land, for example in order to fence-off a given area. In those cases where the net ropes or lines need not have a high tensile strength, the ropes may be given dimensions which enable the net to be knotted by machine. In order to reliably secure the knots, they may be heat welded or melt-glued. It will be understood that the invention can also be modified in several other respects within the scope of the following claims.

I claim:

1. A barrier arrangement for blocking a water passage or channel against the admission of foreign or unfamiliar objects, such as underwater vessels, frogmen and the like, comprising a net (1) of extremely high tensile strength intended to be stretched across the passage or channel, and in which arrangement the net comprises lines (4) which incorporate electrical conductors (5) which are insulated from the surroundings and through which a close circuit current is intended to flow; in which the bottom edge of the net (1) is anchored to the sea-bed and the net arranged to be activated from a passive state, in which the net may rest against the sea-bed, to an active barrier state, to which end the net (1) is connected along its upper edge to an inflatable and deflatable lifting hose (3) which in its evacuated state is essentially flat and which when inflated is able to lift the upper edge of the net to the surface of the water, so as to stretch the net between the sea-bed and said surface, characterized in that the upper and lower edges of the net (1) are respectively braided to anchoring bodies (9) located on the sea-bed and to the lifting hose (3) with the aid of lines (12; 13) which incorporate electrical conductors which are insulated from the surroundings and through which a close circuit current is intended to flow; and in that the conductors are connected to an alarm device, to which the conductors (5) incorporated in the lines (4) forming said net are also connected; and in that the alarm unit is arranged to be activated on the occurrence of an earth fault or a short circuit in any of the connected conductors.

2. An arrangement according to Claim 1, characterized in that the bottom edge of the net (1) is anchored to a continuous elongated body (9) which conforms accurately to the profile of the sea-bed.

3. An arrangement according to claim 1 or 2, characterized in that the side edges of the net (1) are slideably connected to vertical posts or uprights (17, 21).

4. An arrangement according to claim 1 or 2 characterized in that the net (1) is comprised of a plurality of sections which are mutually braided together with the aid of a line which incorporates a signal conductor connected to the alarm device.

5. A method for producing an arrangement according to claim 1 for blocking a water passage or channel against the admission of foreign or unfamiliar objects, such as underwater vessels, frogmen and the like, said arrangement comprising a net of extremely high tensile strength intended to be anchored to the sea-bed and to be raised to an active barrier position with the aid of an inflatable hose, characterized by placing on the seabed a flexible hose in order to provide a net anchorage which accurately conforms to the profile of the sea-bed; subsequently filling the hose with liquid concrete and permitting the concrete to harden in the hose so as to form an elongated anchoring body which conforms to the profile of the sea-bed; and anchoring the net to said elongated body.

6. A method according to claim 5, characterized by inserting net attachment means through the hose wall and into the concrete contained in the hose prior to the concrete hardening.

* * * * *